US005326453A

United States Patent [19]

Endicott et al.

[11] Patent Number: 5,326,453

[45] Date of Patent: Jul. 5, 1994

[54] METHOD AND SOLUTION FOR ELECTRODEPOSITION OF A DENSE, REFLECTIVE TIN OR TIN-LEAD ALLOY

[75] Inventors: Duane W. Endicott, Scottsdale, Ariz.; Michael D. Gernon, North Providence, R.I.; Heng K. Yip, Selangor, Malaysia

[73] Assignees: Motorola, Inc., Schaumburg, Ill.; Technic, Inc., Cranston, R.I.

[21] Appl. No.: 19,729

[22] Filed: Feb. 19, 1993

[51] Int. Cl.[5] ..... C25D 3/32; C25D 3/60

[52] U.S. Cl. ..... 205/50; 204/131; 205/254; 205/302; 205/304

[58] Field of Search ..... 205/254, 299, 304, 50; 204/131

[56] References Cited

U.S. PATENT DOCUMENTS

| | | | |
|---|---|---|---|
| 3,850,765 | 11/1974 | Karustis, Jr. et al. | 204/435 |
| 4,844,780 | 7/1989 | Lee | 204/44.4 |
| 4,923,576 | 5/1990 | Kroll et al. | 204/44.4 |
| 4,981,564 | 1/1991 | Kroll et al. | 204/44.4 |
| 4,994,155 | 2/1991 | Toben et al. | 204/28 |
| 5,061,351 | 10/1991 | Commander et al. | 204/54.1 |
| 5,110,423 | 5/1992 | Little et al. | 205/254 |

*Primary Examiner*—Kathryn Gorgos
*Assistant Examiner*—Edna Wong
*Attorney, Agent, or Firm*—Miriam Jackson

[57] ABSTRACT

New formulations for the electrodeposition of a dense, reflective tin or tin-lead alloy on a cathode have been developed. Such electrodeposition solutions are partially comprised of an additive which is comprised of at least one nonionic surfactant which is electrolyzed prior to starting the electrodeposition process. The electrodeposition solution is also comprised of an amount of an aliphatic dialdehyde kept low enough so that the solder deposits contain no more than 500 ppm of co-electrodeposited carbon. The additive and the aliphatic dialdehyde is mixed with a solution comprised of an alkane or alkanol sulfonic acid and a tin alkane or alkanol sulfonate or a mixture of a tin and lead alkane or alkanol sulfonate to form an electrodeposition solution. A dense, reflective finish is then electrodeposited on a cathode by using such an electrodeposition solution.

23 Claims, No Drawings

METHOD AND SOLUTION FOR ELECTRODEPOSITION OF A DENSE, REFLECTIVE TIN OR TIN-LEAD ALLOY

BACKGROUND OF THE INVENTION

This invention relates, in general, to electrodeposition, including, but not limited to, electrodeposition of a dense, reflective finish on a conductive part.

Methods of electrodeposition, or plating, of a tin or tin-lead alloy (hereinafter referred to as solder or solder deposit) and the compositions of the electrodeposition solutions have been optimized to electrodeposit solder on to a conductive part. In the electronics industry, a conductive part could be the leads of a semiconductor device package, a printed circuit board, or connector.

In particular, in the manufacture of semiconductor devices, the semiconductor device chip is physically and electrically bonded to a leadframe. The semiconductor device is then encapsulated in a package, along with a portion of the leadframe. An electrodeposition process then creates a solder deposit on the leadframe by electrodepositing the solder on all exposed portions of the leadframe.

Following the electrodeposition process, a trim and form press or tool trims away all unwanted metal from the leadframe, singulates the devices, and forms the leads of the device into a predetermined pattern. In the electronics industry it is preferable that the solder deposit have a dense, reflective finish.

The dense, reflective finish is preferable for quality reasons. The higher density and smoothness of a dense, reflective finish reduces the amount of material scraped from the surface of the deposit during the trim and form operations. Scraped material from a normal, matte finish contaminates subsequently processed leads by adhering to the surface of such leads. If a dense, reflective surface is deposited, the need to clean trim and form tools is reduced because the amount of material scraped from the surface of the solder deposit is reduced, and thus productivity is enhanced.

In the past, one problem with electrodepositing a tin or tin-lead alloy having a dense, reflective finish is that such deposits have 800-2000 ppm (parts per million) of occluded carbon (organics). The co-electrodeposition of carbon is not a problem in certain applications. However, in the electronics field, greater than approximately 500 ppm of carbon co-electrodeposited with the tin or tin-lead alloy negatively affects the solderability of the deposit. Therefore, it is desirable to have a method of electrodeposition (and/or use electrodeposition solutions) which produces a dense, reflective tin or tin-lead alloy finish without the co-electrodeposition of greater than approximately 500 ppm of carbon.

SUMMARY OF THE INVENTION

A solution and method for electrodepositing a tin or tin-lead alloy on a cathode comprises providing an alkane or alkanol sulfonic acid and a tin alkane or alkanol sulfonate or a mixture of a tin and lead alkane or alkanol sulfonate, an aliphatic dialdehyde, and an additive comprised of at least one nonionic surfactant, wherein the nonionic surfactant is electrolyzed prior to electrodepositing a tin or tin-lead alloy on a cathode.

DETAILED DESCRIPTION OF THE PREFERRED EMBODIMENT

The present invention relates to a method of electrodeposition of a dense, reflective finish and a composition of an electrodeposition solution used to electrodeposit such a dense, reflective finish. The preferred embodiment relates to a method of electrodepositing a tin or tin-lead alloy having a dense, reflective finish without significant (greater than approximately 500 ppm) co-electrodeposition of carbon in the finish.

The electrodeposition solution is partially comprised of an acid electrolyte and a metal source. In a preferred embodiment, the electrolyte source is comprised of water soluble alkane or alkanol sulfonic acids, the most preferred being methane sulfonic acid. The preferred concentration of the electrolyte is between from about 2-25 percent, the most preferred range being from about 5-20 percent.

Tin alkane or alkanol sulfonate or a mixture of tin and lead alkane or alkanol sulfonates are the preferred sources of metals. Typically, tin and lead salts of methane sulfonic acid are used. The water soluble tin in the solution, as tin methane sulfonate, is from about 10-100 grams per liter as metal, with the most preferred concentration range being from about 20-60 grams per liter. The concentration of lead in the solution, as lead methane sulfonate, is from about 0.25-50 grams per liter as metal. The tin-lead concentration ratio is adjusted accordingly, depending on other solution conditions, to obtain a given desired tin-lead ratio in the electrodeposit.

In a preferred embodiment, the electrodeposition solution is further comprised of a pre-electrolyzed additive comprised of at least two nonionic surfactants (details on the pre-electrolysis given below). This additive may also be comprised of other components which improve electrodeposition performance, such as antioxidants (such as dihydroxybenzene or substituted dihydroxybenzene). In addition, the additive is also preferably comprised of an electrolyte to provide electrical conductivity to the pre-electrolysis process.

In a preferred embodiment, the electrodeposition solution is also comprised of an aliphatic dialdehyde (the term aliphatic dialdehyde is used interchangeably with organic additive), which is not pre-electrolyzed. The aliphatic dialdehyde acts as a primary component to allow the electrodeposition of a dense, reflective finish.

In the preferred embodiment, the nonionic surfactants have a generic structure:

$$R_1-(O-\overset{\overset{\displaystyle R_2}{|}}{C}HCH_2)_m-(O-\overset{\overset{\displaystyle R_3}{|}}{C}HCH_2)_n-(O-\overset{\overset{\displaystyle R_2}{|}}{C}HCH_2)_m-X$$

wherein $R_1$ represents a $C_1$ to $C_{20}$ straight or branched chain alkyl, $$X-\overset{\overset{\displaystyle R_2}{|}}{C}H-CH_2-;$$

X represents a halogen, methoxy, ethoxy, hydroxy, or phenoxy; $R_2$ and $R_3$ represent H or methyl, where $R_2$ does not equal $R_3$; and m and n are an integer from 1 to 100, and preferably 10 to 30 owing to greater availability of these structures. Also, the aliphatic dialdehyde is selected from the group consisting (a) a dialdehyde, represented by the formula:

$$OHC(CH_2)_xCHO$$

wherein x is an integer from 0 to 5; and/or (b) a dialdehyde precursor capable of undergoing acid hydrolysis selected from the group consisting of:

(i) a substituted dihydrofuran represented by the following two formulas:

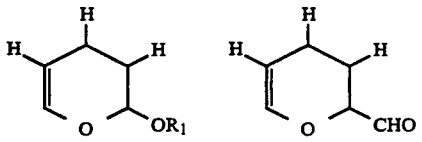

wherein $R_1$ represents hydrogen or a $C_{1-5}$ alkyl group and/or (ii) a substituted dihydrofuran represented by the formulas:

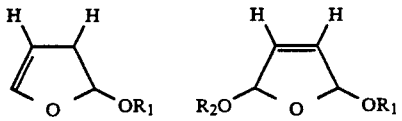

wherein $R_1$ and $R_2$ represent hydrogen or a $C_{1-5}$ alkyl group; and/or (iii) a substituted tetrahydrofuran represented by the formula:

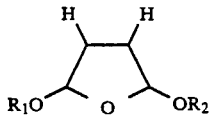

wherein $R_1$ and $R_2$ represent hydrogen or a $C_{1-5}$ alkyl group; and/or (iv) an acetal of dialdehyde represented by the formula:

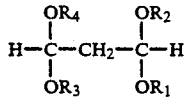

wherein $R_1$, $R_2$, $R_3$, and $R_4$ represent hydrogen or a $C_{1-5}$ alkyl group; x is an integer from 1 to 10; and/or It is possible that other surfactants and aliphatic dialdehydes may be used. For example, one can infer that the aliphatic dialdehyde, due to the similarities in chemical structure, may also selected from the more generic group consisting of:

(a) a dialdehyde, represented by the formula:

$$OHC(CH_2)_x\overset{\overset{R}{|}}{(CH)_y}CHO$$

wherein R is —OH or alkyl; x is an integer from 0 to 5; y is an integer from 0 to 1; and/or (b) a dialdehyde precursor capable of undergoing acid hydrolysis selected from the group consisting of:

(i) a substituted dihydrofuran represented by the following two formulas:

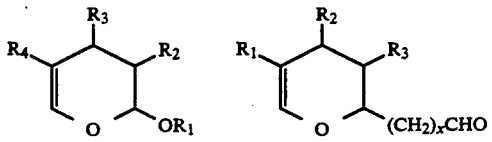

wherein $R_1$, $R_2$, $R_3$, and $R_4$ represent hydrogen or a $C_{1-5}$ alkyl group; x is an integer from 0 to 5; and/or (ii) a substituted dihydrofuran represented by the formulas:

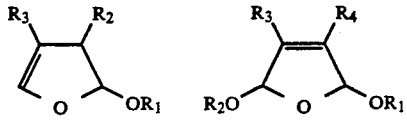

wherein $R_1$, $R_2$, $R_3$, and $R_4$ represent hydrogen or a $C_{1-5}$ alkyl group; and/or (iii) a substituted tetrahydrofuran represented by the formula:

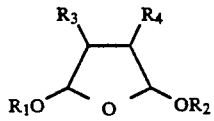

wherein $R_1$, $R_2$, $R_3$, and $R_4$ represent hydrogen or a $C_{1-5}$ alkyl group; and/or (iv) an acetal of dialdehyde represented by the formula:

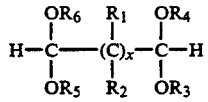

wherein $R_1$, $R_2$, $R_3$, $R_4$, $R_5$, and $R_6$ represent hydrogen or a $C_{1-5}$ alkyl group; x is an integer from 1 to 10; and/or (v) a hydroxysulfonate represented by the formula:

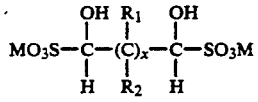

wherein $R_1$ and $R_2$ represent hydrogen, hydroxy-, or a $C_{1-5}$ alkyl group; M is an alkali metal, x is an integer from 0 to 10.

At the present time, an optimal composition for the pre-electrolyzed additive can be obtained commercially from Technic, Inc., under the trade name of "TECHNISOLDER NF Make Up Additive 72-BC". This additive available from Technic, Inc. produces a solder deposit which has good thickness distribution and alloy composition. In addition, possible surfactants, aliphatic dialdehydes and antioxidants are also listed in U.S. Pat.

No. 5,110,423, issued on May 5, 1992, to Little et al, U.S. Pat. No. 4,923,576, issued on May 8, 1990, to Kroll et al, U.S. Pat. No. 4,981,564 issued on Jan. 1, 1991, to Kroll et al, which are all hereby incorporated by reference.

In the present invention, for the electronics industry, it is critical that the concentration of the aliphatic dialdehyde(s) be no greater than an amount which deposits 500 ppm of carbon in the solder deposit. This concentration may vary according to the other conditions of the electrodeposition solution. In a most preferred embodiment, the aliphatic dialdehyde is comprised of glutaric dialdehyde having a concentration in the electrodeposition solution in the range of 50 to less than 400 ppm. Such an electrodeposition solution enabled the electrodeposition of a dense, reflective finish with less than 500 ppm of occluded carbon. An amount of glutaric dialdehyde less than 50 ppm will not produce a dense, reflective finish. This amount is less than what has been disclosed in the past necessary to electrodeposit a dense, reflective finish. In the present invention, this amount of glutaric dialdehyde produces a dense, reflective finish when combined with the pre-electrolyzed additive.

As stated above, the electrolysis of the additive prior to electrodeposition is also necessary to electrodeposit a low carbon, dense, reflective finish on a cathode or leadframe. It is believed that by electrolysis, modification of the surfactants occurs. Such modified compounds form a secondary component(s), which along with the primary component (the aliphatic dialdehyde), allows for the electrodeposition of a low carbon, dense, reflective finish. The exact structure of such electrolysis product is difficult to characterize. It is believed that the secondary component is produced by electrolytic modification of surfactant terminal groups.

After this pre-electrolysis step, the pre-electrolyzed additive and the aliphatic dialdehyde are combined with the electrolyte(s), and the metal salt(s) sources to form the electrodeposition solution. This electrodeposition solution is then used to electrodeposit the tin or tin-lead alloy on a cathode.

It is possible that the electrodeposition solution may be comprised of only one surfactant; and that the one surfactant can be electrolyzed before they are mixed with the remaining components which comprise the electrodeposition solution to begin electrodepositing. Generally, then, the electrodeposition solution can be comprised of an electrolyte; a metal source; an additive comprised of at least one surfactant which is electrolyzed prior to electrodeposition; and an aliphatic dialdehyde. An antioxidant is also typically included in the additive.

The electrodeposition solution is placed in a tank for electrodepositing the tin or tin-lead alloy on a cathode. The method and equipment used to electrodeposit the metal on the cathode is well known in the art.

It is important to note that including an amount of the aliphatic dialdehyde greater than approximately 400 ppm, and typically greater than 4000 ppm, without pre-electrolyzing a solution of at least one of the surfactants, also will allow one to also electrodeposit a dense, reflective finish onto a cathode. However, when the electrodeposition solution is comprised of greater than 400 ppm of the aliphatic dialdehyde, greater than 500 ppm of carbon will typically be co-electrodeposited in the solder. As stated previously, this amount of organic co-electrodeposition is undesirable in the electronics industry for solderability reasons.

In the present invention, the pre-electrolysis of at least a solution of one surfactant must be carried out prior to electrodeposition. Thus, the combination of the pre-electrolysis of at least one surfactant and adding an amount of the aliphatic dialdehyde (50–400 ppm) which does not co-electrodeposit more than 500 ppm of carbon is the key to forming an electrodeposition solution which will electrodeposit a dense, reflective tin or tin-lead alloy finish without the co-electrodeposition of greater than 500 ppm of carbon.

If the present invention is followed, a dense, reflective solder deposit is formed on the cathode. The high density improves the solderability of the finish, as well as extending the amount of time between cleaning of trim and form tools. In addition, the dense, reflective finish has also been found to extend the shelf life solderability, as determined by steam aging semiconductor devices having a dense, reflective finish electrodeposited on the leads. The semiconductor devices having a dense, reflective finish fabricated using the present invention have been found to have a shelf life solderability of 2 to 5 times greater than semiconductor devices having a low density or matte finish electrodeposited on the leads.

EXAMPLE

The following is an example of the process used to electrodeposit a dense, reflective finish on a cathode. The electrodeposition solution is comprised of the components as described above. In a preferred embodiment, neat "TECHNI-SOLDER NF Make Up Additive 72-BC" available from Technic, Inc. is electrolyzed for approximately 0.4 to 4.8 amp-hours/liter. If the "TECHNI-SOLDER NF Make Up Additive 72-BC" is electrolyzed for less than 0.4 to 4.8 amp-hours/liter, a dense, reflective finish will not be electrodeposited at the beginning of the electrodeposition process.

The "TECHNI-SOLDER NF Make Up Additive 72-BC" which has been pre-electrolyzed is then added to a solution of alkyl sulfonic acid and an alkyl tin sulfonate or a mixture or an alkyl tin and lead sulfonate. In order to begin electrodepositing a dense, reflective finish with less than or equal to 500 ppm of carbon, the pre-electrolyzed "TECHNI-SOLDER NF Make Up Additive 72-BC" should be in the range of 12–20% volume of the electrodeposition solution.

Then, an amount of glutaric dialdehyde is added such that a total of 50–400 ppm is in the electrodeposition solution. In the preferred embodiment, it is advantageous to add the additional amount of glutaric dialdehyde after the pre-electrolysis, because the glutaric dialdehyde may partially breakdown during the electrolysis. The electrodeposition process may then begin. The process of electrodepositing the solder on to a cathode is well known in the art.

To maintain electrodeposition of a dense, reflective finish without a greater than 500 ppm of occluded carbon, the volume of the TECHNI-SOLDER NF Make Up Additive 72-BC available from Technic, Inc. must be maintained at 12–20%. As long as electrolysis of the solution (e.g. during electrodeposition) is not stopped for over a 48 hour period, only an extra amount of TECHNI-SOLDER NF Make Up Additive 2-BC available from Technic, Inc. (which need not be electrolyzed) must be added to maintain the 12–20% volume range to maintain electrodepositing a dense, reflective finish.

If the solution is not used over a 48 hour period, pre-electrolyzed TECHNI-SOLDER NF Make Up Additive 72-BC available from Technic, Inc. must be added to the solution in order to begin electrodepositing a dense, reflective finish again.

Over time, the stannous tin (Sn II) in the solution oxidizes to stannic tin (Sn IV). A large amount of stannic tin is undesirable, so flocculation treatments are performed when stannic tin is typically greater than 3.0 oz/gallon of the electrodeposition solution. The performance of flocculation treatments are well known in the art. Briefly, a resin which binds to the stannic tin is added to the solution and then the resin is removed.

A carbon filtration is performed to reduce the level of organic contaminates in the electrodeposition solution and also to remove the unbound resin remaining from the flocculation treatment. Tis carbon filtration also removes desirable organic additives, including the aliphatic dialdehyde, so an additional amount of pre-electrolyzed TECHNI-SOLDER NF Make Up Additive 72-BC (available from Technic, Inc.) and an additional amount of the aliphatic dialdehyde (un-electrolyzed) must be added, as described above, in order to begin electrodepositiong a low carbon, dense, reflective finish again.

We claim:

1. An electrodeposition solution for electrodepositing a tin or tin-lead alloy on a cathode, comprising:

an alkane or alkanol sulfonic acid and a tin alkane or alkanol sulfonate or a mixture of a tin and lead alkane or alkanol sulfonate;

a modified additive comprised of at least one nonionic surfactant, wherein an additive is electrolyzed prior to electrodepositing a tin or tin-lead alloy on a cathode to form the modified additive; and an aliphatic dialdehyde.

2. The electrodeposition solution of claim 1 wherein the aliphatic dialdehyde is selected from the group consisting of at least:

(a) a dialdehyde, represented by the formula:

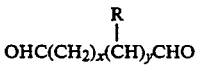

wherein R is —OH or alkyl; x is an integer from 0 to 5; y is an integer from 0 to 1, or (b) a dialdehyde precursor capable of undergoing acid hydrolysis selected from the group consisting of at least:

(i) a substituted dihydrofuran represented by the following two formulas:

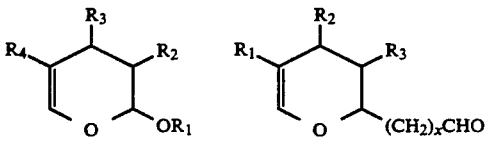

wherein $R_1$, $R_2$, $R_3$, and $R_4$ represent hydrogen or a $C_{1-5}$ alkyl group; x is an integer from 0 to 5, (ii) a substituted dihydrofuran represented by the formulas:

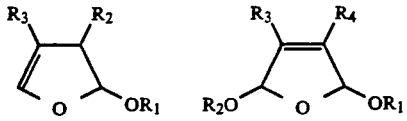

wherein $R_1$, $R_2$, $R_3$, and $R_4$ represent hydrogen or a $C_{1-5}$ alkyl group, (iii) a substituted tetrahydrofuran represented by the formula:

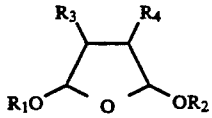

wherein $R_1$, $R_2$, $R_3$, and $R_4$ represent hydrogen or a $C_{1-5}$ alkyl group, (iv) an acetal of dialdehyde represented by the formula

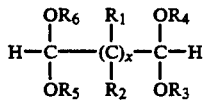

wherein $R_1$, $R_2$, $R_3$, $R_4$, $R_5$, and $R_6$ represent hydrogen or a $C_{1-5}$ alkyl group; x is an integer from 1 to 10, or (v) a hydroxysulfonate represented by the formula:

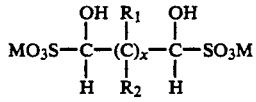

wherein $R_1$ and $R_2$ represent hydrogen, hydroxy-, or a $C_{1-5}$ alkyl group; M is an alkali metal, x is an integer from 0 to 10.

3. The electrodeposition solution of claim 1 wherein the aliphatic dialdehyde is comprised of glutaric dialdehyde.

4. The electrodeposition solution of claim 3 wherein the concentration of the glutaric dialdehyde is 50–400 ppm.

5. The electrodeposition solution of claim 1 wherein the concentration of the aliphatic dialdehyde is such that it results in no more than 500 ppm of co-electrodeposited carbon in the electrodeposited tin or tin-lead alloy.

6. The electrodeposition solution of claim 1 wherein the modified additive is maintained at a 12–20% volume of the electrodeposition solution.

7. The electrodeposition solution of claim 1 wherein the additive is electrolyzed for approximately 0.4 to 4.8 amp-hours/liter to form the modified additive.

8. The electrodeposition solution of claim 1 wherein the additive is comprised of at least two nonioic surfactants, and wherein the additive is electrolyzed prior to electrodepositing a tin or tin-lead alloy on a cathode.

9. The electrodeposition solution of claim 8 wherein the additive is comprised of TECHNI-SOLDER NF Make Up Additive 72-BC.

10. A method of forming a tin or tin-lead alloy electrodeposition solution, comprising the steps of:

providing an additive comprised of a nonionic surfactant;

electrolyzing the additive to form a modified additive; and mixing the modified additive with an aliphatic dialdehyde, an alkane or alkanol sulfonic acid, and a tin alkane or alkanol sulfonate or a mixture of a tin and lead alkane or alkanol sulfonate to form the electrodeposition solution.

11. The method of claim 10 wherein the step of mixing the additive modified comprises providing the aliphatic dialehyde selected from the group consisting of at least:

(a) a dialdehyde, represented by the formula:

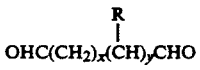

wherein R is —OH or alkyl; x is an integer from 0 to 5; y is an integer from 0 to 1, or (b) a dialdehyde precursor capable of undergoing acid hydrolysis selected from the group consisting of at least:

(i) a substituted dihydrofuran represented by the following two formulas:

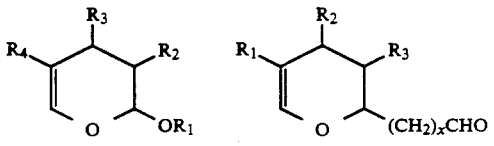

wherein $R_1$, $R_2$, $R_3$, and $R_4$ represent hydrogen or a $C_{1-5}$ alkyl group; x is an integer from 0 to 5, (ii) a substituted dihydrofuran represented by the formulas:

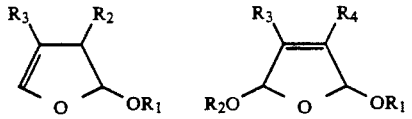

wherein $R_1$, $R_2$, $R_3$, and $R_4$ represent hydrogen or a $C_{1-5}$ alkyl group, (iii) a substituted tetrahydrofuran represented by the formula:

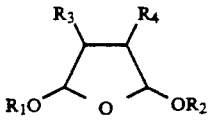

wherein $R_1$, $R_2$, $R_3$, and $R_4$ represent hydrogen or a $C_{1-5}$ alkyl group, (iv) an acetal of dialdehyde represented by the formula:

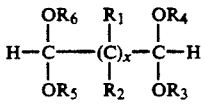

wherein $R_1$, $R_2$, $R_3$, $r_4$, $R_5$, and $R_6$ represent hydrogen or a $C_{1-5}$ alkyl group; x is an integer from 1 to 10, or (v) a hydroxysulfonate represented by the formula:

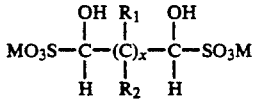

wherein $R_1$ and $R_2$ represent hydrogen, hydroxy-, or a $C_{1-5}$ alkyl group; M is an alkali metal, x is an integer from 0 to 10.

12. The method of claim 10 wherein the step of mixing the modified additive comprises providing glutaric dialdehyde as the aliphatic dialdehyde.

13. The method of claim 12 wherein the step of providing the glutaric dialdehyde comprises providing glutaric dialdehyde having a concentration of 50–400 ppm of the electrodeposition solution.

14. The method of claim 10 wherein the step of mixing the modified additive comprises providing a concentration of the aliphatic dialdehyde so that it results in no more than 500 ppm of co-electrodeposited carbon in a tin or tin-lead alloy deposit.

15. The method of claim 10 further comprising maintaining the modified additive at a 12–20% volume of the electrodeposition solution.

16. The method of claim 10 wherein the step of electrolyzing is performed for approximately 0.4 to 4.8 amp-hours/liter of the additive to form the modified additive.

17. A method of electrodepositing a tin or tin-lead alloy on a cathode, comprising the steps of:

electrolyzing an additive comprised of a nonionic surfactant to form a modified additive;

providing a solution comprised of an alkane or alkanol sulfonic acid and a tin alkane or alkanol sulfonate or a mixture of a tin and lead alkane or alkanol sulfonate;

providing an aliphatic dialdehyde;

forming an electrodeposition solution by mixing the modified additive with the solution comprised of the alkane or alkanol sulfonic acid and the tin alkane or alkanol sulfonate or the mixture of a tin and lead alkane or alkanol sulfonate and the aliphatic dialdehyde; and using the electrodeposition solution comprised of the modified additive to electrodeposit the tin or tin-lead alloy on the cathode.

18. The method of claim 17 wherein the step of providing the aliphatic dialdehyde comprises providing the aliphatic dialdehyde selected from the group consisting of at least:

(a) a dialdehyde, represented by the formula:

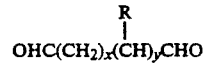

wherein R is —OH or alkyl; x is an integer from 0 to 5; y is an integer from 0 to 1, or (b) a dialdehyde precursor capable of undergoing acid hydrolysis selected from the group consisting of at least:

(i) a substituted dihydrofuran represented by the following two formulas:

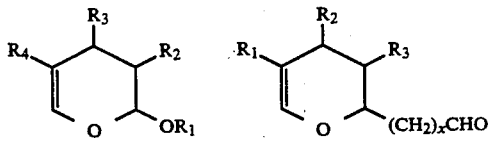

wherein $R_1$, $R_2$, $R_3$, and $R_4$ represent hydrogen or a $C_{1-5}$ alkyl group; x is an integer from 0 to 5, (ii) a substituted dihydrofuran represented by the formulas:

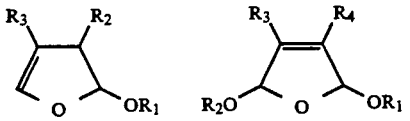

wherein $R_1$, $R_2$, $R_3$, and $R_4$ represent hydrogen or a $C_{1-5}$ alkyl group, (iii) a substituted tetrahydrofuran represented by the formula:

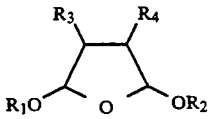

wherein $R_1$, $R_2$, $R_3$, and $R_4$ represent hydrogen or a $C_{1-5}$ alkyl group, an acetal of dialdehyde represented by the formula:

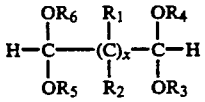

wherein $R_1$, $R_2$, $R_3$, $R_4$, $R_5$, and $R_6$ represent hydrogen or a $C_{1-5}$ alkyl group; x is an integer from 1 to 10, or (v) a hydroxysulfonate represented by the formula:

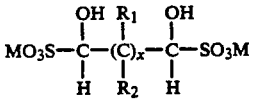

wherein $R_1$ and $R_2$ represent hydrogen, hydroxy-, or a $C_{1-5}$ alkyl group; M is an alkali metal, x is an integer from 0 to 10.

19. The method of claim 17 wherein the step of providing the aliphatic dialdehyde comprises providing glutaric dialdehyde as the aliphatic dialdehyde.

20. The method of claim 17 wherein the step of providing the glutaric dialdehyde comprises providing glutaric dialdehyde having a concentration of approximately 50–400 ppm of the electrodeposition solution.

21. The method of claim 17 wherein the step of providing the aliphatic dialdehyde comprises providing the aliphatic dialdehyde having a concentration such that it results in no more than 500 ppm of co-electrodeposited carbon on the cathode.

22. The method of claim 17 further comprising maintaining the modified additive at a 12–20% volume of the electrodeposition solution.

23. The method of claim 17 wherein the step of electrolyzing is performed for approximately 0.4 to 4.8 amp-hours/liter of the additive to form the modified additive.

* * * * *

UNITED STATES PATENT AND TRADEMARK OFFICE

CERTIFICATE OF CORRECTION

PATENT NO. : 5,326,453

DATED : July 5, 1994

INVENTOR(S) : Duane Endicott et al.

It is certified that error appears in the above-identified patent and that said Letters Patent is hereby corrected as shown below:

Column 3, line 9, delete "dihydrofuran" and insert --dihydropyran--.

Column 4, line 4, delete "dihydrofuran" and insert --dihydropyran--.

Column 7, line 55, delete "dihydrofuran" and insert --dihydropyran--.

Column 9, line 26, delete "dihydrofuran" and insert --dihydropyran--.

Column 10, line 67, delete "dihydrofuran" and insert --dihydropyran--.

Signed and Sealed this

Twenty-first Day of December, 1999

*Attest:*

Q. TODD DICKINSON

*Attesting Officer*

*Acting Commissioner of Patents and Trademarks*